US009739013B2

(12) United States Patent
Kida et al.

(10) Patent No.: US 9,739,013 B2
(45) Date of Patent: Aug. 22, 2017

(54) LOW IGNITION PROPENSITY CIGARETTE AND WRAPPING PAPER THEREFOR

(75) Inventors: Shinzo Kida, Tokyo (JP); Masaaki Fukaya, Tokyo (JP); Ken Uyama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 12/481,908

(22) Filed: Jun. 10, 2009

(65) Prior Publication Data

US 2009/0301506 A1 Dec. 10, 2009

Related U.S. Application Data

(63) Continuation of application No. PCT/JP2007/073502, filed on Dec. 5, 2007.

(30) Foreign Application Priority Data

Dec. 11, 2006 (JP) ..... 2006-333317

(51) Int. Cl.
*A24D 1/02* (2006.01)
*D21H 25/04* (2006.01)
*D21H 27/00* (2006.01)

(52) U.S. Cl.
CPC ..... *D21H 25/04* (2013.01); *A24D 1/02* (2013.01); *A24D 1/025* (2013.01); *D21H 27/00* (2013.01)

(58) Field of Classification Search
CPC ..... A24D 1/02; A24D 1/025; D21H 25/04; D21H 27/00
USPC ..... 131/365
See application file for complete search history.

(56) References Cited

U.S. PATENT DOCUMENTS

| | | | | |
|---|---|---|---|---|
| 4,077,414 | A * | 3/1978 | Baker et al. | 131/336 |
| 4,615,345 | A | 10/1986 | Durocher | |
| 4,945,932 | A | 8/1990 | Mentzel et al. | |
| 5,127,142 | A * | 7/1992 | Howard | 492/33 |
| 2003/0131860 | A1 * | 7/2003 | Ashcraft et al. | 131/365 |
| 2003/0136420 | A1 | 7/2003 | Kraker | |

(Continued)

FOREIGN PATENT DOCUMENTS

| | | | |
|---|---|---|---|
| CA | 2599753 | A1 | 9/2006 |
| JP | 1-225473 | A | 9/1989 |

(Continued)

OTHER PUBLICATIONS

Ukranian Decision on Grant issued Sep. 8, 2010 in corresponding Ukranian Patent Application No. 200907260 (with English translation).

(Continued)

*Primary Examiner* — Michael H Wilson
*Assistant Examiner* — Dionne Walls Mayes
(74) *Attorney, Agent, or Firm* — Birch, Stewart, Kolasch & Birch, LLP

(57) ABSTRACT

A low ignition propensity cigarette has wrapping paper (6) wrapping filling material into a rod-like shape, and the wrapping paper (6) includes highly conducting bands (10) formed by calendering and arranged in a longitudinal direction of the cigarette, the highly conducting bands (10) having higher thermal conductivity than inherent thermal conductivity of the wrapping paper (6), and burning depression bands (16) formed in the wrapping paper (6) and superposed upon the respective highly conducting bands (10).

6 Claims, 8 Drawing Sheets

(56) References Cited

U.S. PATENT DOCUMENTS

| | | | | |
|---|---|---|---|---|
| 2004/0011368 | A1 | 1/2004 | Tsutsumi et al. | |
| 2004/0020502 | A1* | 2/2004 | Tosas Fuentes et al. | 131/284 |
| 2009/0324893 | A1* | 12/2009 | Soder et al. | 428/172 |

FOREIGN PATENT DOCUMENTS

| | | | |
|---|---|---|---|
| JP | 2005-514939 | A | 5/2005 |
| JP | 2005-273073 | A | 10/2005 |
| WO | WO 97/20107 | * | 6/1997 |
| WO | WO-02/054892 | A1 | 7/2002 |
| WO | WO 03/061410 | A1 | 7/2003 |

OTHER PUBLICATIONS

Extended European Search Report issued May 31, 2012, in European Patent Application No. 07850126.9.

* cited by examiner

LOW IGNITION PROPENSITY CIGARETTE AND WRAPPING PAPER THEREFOR

CROSS-REFERENCE TO RELATED APPLICATIONS

This application is a Continuation of co-pending PCT International Application No. PCT/JP2007/073502 filed on Dec. 5, 2007, which designated the United States, and on which priority is claimed under 35 U.S.C. §120. This application also claims priority under 35 U.S.C. §119(a) on Patent Application No. 2006-333317 filed in Japan on Dec. 11, 2006. The entire contents of each of the above documents is hereby incorporated by reference into the present application.

TECHNICAL FIELD

The present invention relates to a low ignition propensity cigarette that reduces the possibility of a burnable material when the lighted cigarette is placed on the burnable material, wrapping paper for the cigarette, and a method of producing wrapping paper.

BACKGROUND ART

Well-known low ignition propensity cigarettes of this type include a self-distinguishing cigarette disclosed, for example, in Patent Document 1. This cigarette has filling material and single wrapping paper that wraps the filling material in a rod-like shape. The wrapping paper includes high and low air permeable regions that are alternately arranged in an axial direction of the cigarette. The high and low air permeable regions each form a shape of a band extending in a circumferential direction of the cigarette.

When the self-extinguishing cigarette is in a smoldering state at its distal end as the smoker does not puff the cigarette after lighting it, the fire cone is automatically extinguished by the low air permeable region at the point of reaching the low air permeable region. Patent Document 1: Unexamined Japanese Patent Publication No. 1-225473

DISCLOSURE OF THE INVENTION

Problems to be Solved by the Invention

The low air permeable region of the wrapping paper, which realizes the automatic extinguishment, has extremely low air permeability as compared to air permeability of a high air permeable region. There is a great difference in air permeability between the low and high air permeable regions. During smoking, therefore, a great difference occurs between the draw resistance of a cigarette when the fire cone is in the high air permeable region and the draw resistance of the cigarette when the fire cone is in the low air permeable region. This difference brings discomfort to the smoker.

If the number of the low air permeable regions per self-extinguishing cigarette is increased in order to prevent an accident fire attributable to a cigarette, the suction resistance of the whole cigarette is inevitably increased. Such a cigarette fails to provide pleasant smoking to the smoker.

It is an object of the invention to provide a low ignition propensity cigarette that is proper for prevention of an accident fire without ruining pleasant smoking, wrapping paper thereof, and a method of producing wrapping paper.

Means for Solving the Problem

In order to achieve the above object, the low ignition propensity cigarette according to the present invention comprises filling material and a single wrapping paper wrapping the filling material into a rod-like shape. The wrapping paper includes a highly conducting zone formed by calendering and having higher thermal conductivity than inherent thermal conductivity, and a burning depression layer formed by coating a burning depression agent onto the wrapping paper, for reducing burning speed of the wrapping paper.

In a dangerous situation where the low ignition propensity cigarette is lighted and placed on a burnable material while having smolder, when the fire cone of the cigarette reaches the highly conducting zone, the highly conducting zone releases the heat of the fire cone to the burnable material to reduce the temperature of the fire cone. When the fire cone reaches the burning depression layer of the wrapping paper, the burning depression layer prevents the wrapping paper from being burnt and reduces the temperature of the fire cone. The temperature of the fire cone is thus reduced at any rate. Even in the dangerous situation as mentioned above, the possibility that the flame spreads to the burnable material is reduced.

Preferably, the burning depression layer has a portion overlapping with the highly conducting zone. In this case, when the fire cone reaches overlapping portions of the burning depression layer and the highly conducting zone, the burning depression layer and the highly conducting zone reduce the temperature of the fire cone in cooperation with each other. This provides a higher effect of preventing the flame spreading.

In a normal smoking state where a puff action is repeated with respect to the low ignition propensity cigarette, the fire cone can be supplied with oxygen from air that enters the cigarette. Regardless of the highly conducting zone and the burning depression layer, the fire cone is kept smoldering.

When the burning depression layer is formed by coating the highly conducting zone with a burning depression agent after the highly conducting zone is formed in the wrapping paper by calendering, the burning depression agent fits well onto the highly conducting zone. It is therefore possible to form the burning depression layer simply by coating the highly conducting zone with the burning depression agent only once.

To be specific, the highly conducting zone is either formed over the entire wrapping paper or as bands arranged at predetermined intervals in an axial direction of the low ignition propensity cigarette, the bands surrounding the entire circumference of the low ignition propensity cigarette. In this case, even if the low ignition propensity cigarette is placed on a burnable material in any condition, the bands of the highly conducting zone contact the burnable material and reduce the temperature of the fire cone of the cigarette.

When the highly conducting zone is formed of a plurality of bands, it is preferable that the burning depression layer also include a plurality of bands, and that the bands of the highly conducting zone and of the burning depression layer be superposed upon each other. In this case, even in the dangerous situation as mentioned above, the bands of the highly conducting zone and of the burning depression layer reliably extinguish the fire cone of the cigarette and determine an extinction position of the fire cone.

Preferably, the burning depression layer is formed on an inner surface of the wrapping paper (claim 6). In this case, since the highly conducting zone is located between the burning depression layer and the burnable material, functions of the highly conducting zone are not hampered by the burning depression layer in a dangerous situation.

Preferably, the bands of the highly conducting zone are formed of recesses obtained by concaving parts of the wrapping paper by calendering, and the recesses each have slant edges on both ends separated away from each other in a longitudinal direction of the low ignition propensity cigarette.

The present invention further provides wrapping paper for the above-described low ignition propensity cigarette. The wrapping paper includes the highly conducting zone and the burning depression layer.

The invention further provides a method of producing the wrapping paper. The producing method includes the steps of forming in a web made of paper material the highly conducting zone having higher thermal conductivity than the inherent thermal conductivity of the web, and coating the web with the burning depression agent either before or after the calendering to form the burning depression layer for reducing burning speed of the web.

Preferably, the calendering forms the highly conducting zone by applying pressure of 15 to 25 N/mm to the web.

Technical Advantage of the Invention

The low ignition propensity cigarette and the wrapping paper of the invention greatly reduce the possibility that flame spreads to a burnable material due to the fire cone of the low ignition propensity cigarette even in the dangerous situation.

The air permeability of the highly conducting region obtained by calendering is not greatly reduced lower than the inherent air permeability of the wrapping paper. Moreover, when the highly conducting zone is formed of a plurality of bands, the draw resistance of the low ignition propensity is not substantially changed during smoking, so that the smoker does not feel discomfort.

The method of producing the wrapping paper forms the highly conducting zone while regulating the pressure to be applied to the web within the range of from 15 to 25 N/mm. The method accordingly prevents the web from being ripped, and is capable of stably forming the highly conducting zone.

BEST MODE FOR CARRYING OUT THE INVENTION

Figure 1:
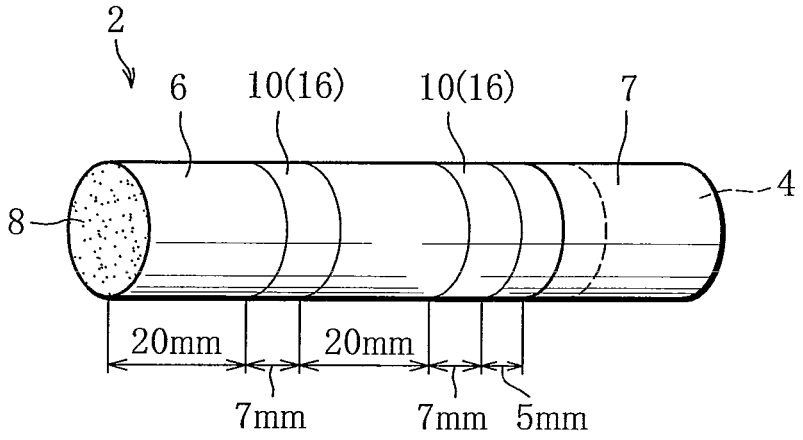
FIG. 1 is a schematic perspective view showing a low ignition propensity cigarette of one embodiment.

A filter cigarette shown in FIG. 1 includes a cigarette 2 with a low ignition propensity, a filter 4 adjacent to a proximal end of the cigarette 2, and tipping paper 7 connecting the cigarette 2 and the filter 4 to each other.

The cigarette 2 has filling material 8 and single wrapping paper 6 that wraps the filling material in a rod-like shape. The filling material 8 includes not only shred tobacco obtained by shredding leaf tobacco but also reconstructed shred tobacco obtained by shredding a reconstructed tobacco sheet, expanded shred tobacco obtained by subjecting shred tobacco to expansion processing, etc.

As for thermal conductivity, the wrapping paper 6 has two highly conducting bands 10 functioning as a highly conducting zone. The highly conducting bands 10 are arranged away from each other in an axial direction of the cigarette 2 and extend around the cigarette 2 over the entire circumference of the cigarette 2. More specifically, a first highly conducting band 10 is set at 20 mm away from a distal end of the cigarette 2, and a second highly conducting band 10 at 20 mm away from the first highly conducting band 10 in the axial direction of the cigarette 2. The highly conducting bands 10 have a width of 7 mm. The second highly conducting band 10 and the tipping paper 7 are set at 5 mm away from each other. The cigarette 2 has a total length of about 85 mm and a circumferential length of 25 mm.

The highly conducting bands 10 are obtained by treating the wrapping paper 6 with calendering. The highly conducting bands 10 thus obtained have higher thermal conductivity than inherent thermal conductivity of other portions of the wrapping paper 6, which have not undergone the calendering, namely, the inherent thermal conductivity of the wrapping paper itself.

Figure 2:
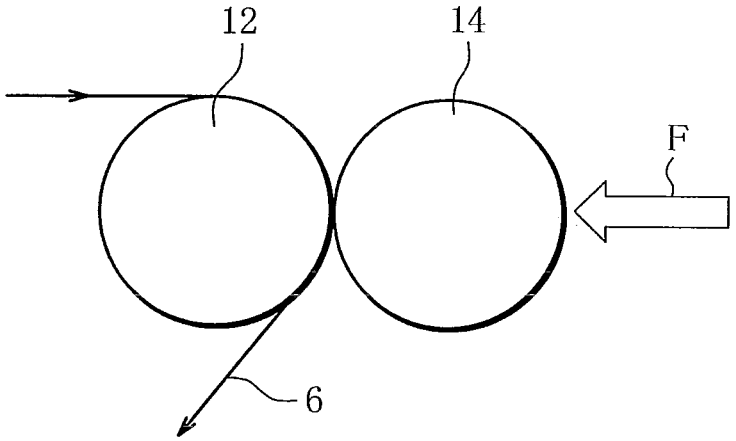
FIG. 2 is a view showing a principle of calendering.

FIG. 2 shows a calendering machine. The machine applies calendering to the wrapping paper 6 before the wrapping paper 6 is used for production of the cigarette 2. The machine includes a calendering roller 12 and a press roller 14. The press roller 14 is pressed against the calendering roller 12 by a predetermined pressure, or more specifically, the pressure F ranging from 15 to 25 N/mm. When the wrapping paper 6 passes through between the calendering roller 12 and the press roller 14, the highly conducting bands 10 each having the above-mentioned width are formed in the wrapping paper 6 at predetermined intervals in a running direction of the wrapping paper 6. When the wrapping paper 6 subjected to the calendering is used for production of the cigarette 2, therefore, the cigarette 2 having two highly conducting bands 10 in the wrapping paper 6 is obtained as illustrated in FIG. 1.

Figure 3:
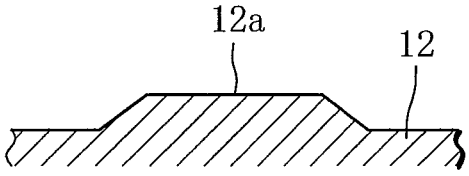
FIG. 3 is a sectional view showing a part of an outer circumference of a calender roll shown in FIG. 2.

To be more specific, the calendering roller 12 is made of steel. Pressing protrusions 12 as shown in FIG. 3 are formed in an outer circumferential surface of the calendering roller 12 at the above-mentioned intervals. As viewed in a cross-section of the calendering roller 12, the pressing protrusion 12*a* has a trapezoidal shape. As viewed in a rotating direction of the calendering roller 12, therefore, front and rear edge faces of the pressing protrusions 12*a* are both inclined.

Figure 4:
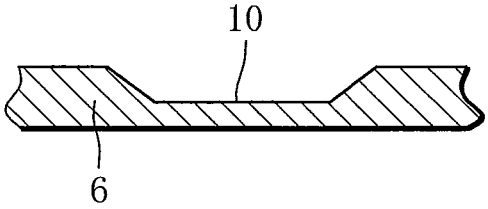
FIG. 4 is a sectional view showing a calendered area formed in wrapping paper of the cigarette shown in FIG. 1.

After the wrapping paper 6 passes through between the calendering roller 12 and the press roller 14, recessed portions shown in FIG. 4 are formed at intervals in an interior surface of the wrapping paper 6. These recessed portions become the highly conducting bands 10. The highly conducting bands 10 each have a shape in a complementary relationship with a shape of the pressing protrusion 12*a*, so that both end edge faces of each of the highly conducting bands 10, which are positioned away from each other in the longitudinal direction of the wrapping paper 6, are inclined, too. When the highly conducting bands 10 are formed of the recessed portions having the inclined edges, the load applied to the wrapping paper 6 during the calendering of the wrapping paper 6 is reduced, and the wrapping paper 6 is not ripped in the end edges of the highly conducting bands 10.

The press roller 14 is made of steel, cotton fiber, aramid fiber, rubber or the like, and is not limited in material. Nevertheless, the material of the press roller 14 is preferably softer than that of the calendering roller 12.

In comparison between inherent thermal conductivity of the wrapping paper 6 and thermal conductivity of the highly conducting bands 10, an increase rate of the thermal conductivity of the highly conducting bands to the inherent thermal conductivity depends upon the material of the calendering and press rollers 12 and 14 and pressure as shown in TABLE 1 below.

TABLE 1

| Wrapping Paper | Calendering | Details of Calendering | Average Thermal Conductivity (W/(K · m)) | Increase Rate of Thermal Conductivity (%) |
|---|---|---|---|---|
| A | NO | — | 0.2435 | — |
| B | NO | — | 0.2533 | — |
| A | YES | S & S (15) | 0.2874 | 18.0 |
| A | YES | S & S (18) | 0.2616 | 7.4 |
| A | YES | S & S (25) | 0.2935 | 15.8 |
| A | YES | C & S (25) | 0.2837 | 16.5 |
| A | YES | A & S (25) | 0.2877 | 18.2 |
| B | YES | S & S (15) | 0.3146 | 24.2 |
| B | YES | S & S (18) | 0.3047 | 20.3 |
| B | YES | S & S (25) | 0.3235 | 27.7 |
| B | YES | C & S (25) | 0.3142 | 24.0 |
| B | YES | A & S (25) | 0.2893 | 14.2 |

In TABLE 1, A and B represent wrapping papers different in air permeability. The wrapping papers A and B have 72 and 35 Coresta units, respectively. The average thermal conductivities of the wrapping papers A and B that have not been calendered indicate the inherent thermal conductivities of the wrapping papers A and B.

The S & S (number), C & S (number), and A & S (number) presented under the Details of Calendering in TABLE 1 denote "the material of the press roller 14" & "the material of the calendering roller" (pressure (N/mm)). Letters S, C, and A represent steel, cotton fiber, and aramid fiber, respectively.

Figure 5:
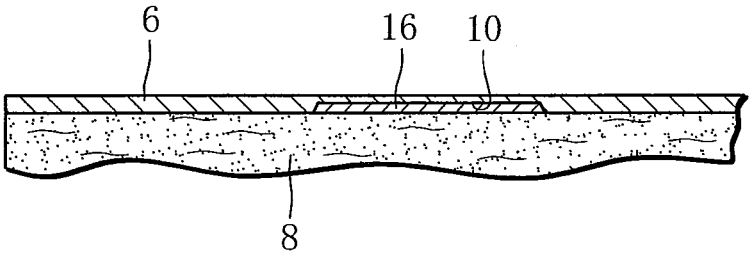
FIG. 5 is a longitudinal sectional view showing a part of the cigarette shown in FIG. 1.

As illustrated in FIG. 5, the highly conducting bands 10 are formed in the interior surface of the wrapping paper 6. In the recessed portions where the highly conducting bands 10 are formed, there are formed burning depression layers, or burning depression bands 16. More specifically, the burning depression bands 16 are formed by coating a solution of a burning depression agent, such as CMC (carboxymethyl cellulose) and sodium alginate, onto the highly conducting bands 10, namely, the recessed portions. The burning depression bands 16 are superposed upon the respective highly conducting bands 10.

The burning depression bands 16 compensate shortage of the thermal conductivity required for the highly conducting bands 10. More specifically, in such a dangerous situation that the lighted cigarette 2 is placed on a burnable material, the highly conducting bands 10 are required to have a thermal conductivity of at least about 0.45 W/(K·m) to reliably extinguish a smolder of the cigarette 2 in a state of smoldering in the highly conducting bands 10.

However, the thermal conductivities of the highly conducting bands 10 in TABLE 1 are lower than 0.45 W/(K·m). The burning depression bands 16 are superposed upon the highly conducting bands 10 and are made by a predetermined coating amount to compensate the shortage of the thermal conductivities of the highly conducting bands 10.

A low ignition propensity cigarette disclosed in U.S. Pat. No. 3,785,144 includes inner wrapping paper having a thermal conductivity raging from 0.50 to 0.56 W/(K·m). Difference between the thermal conductivity of the inner wrapping paper and the thermal conductivity required for the highly conducting bands 10 of the invention (0.45 W/(K·m)) results from the difference between the single wrapping paper 6 of the invention and the double wrapper disclosed in the above publication. The double wrapper has a double structure made of the inner wrapping paper and an outer wrapping paper.

TABLE 2 below shows results of evaluation on fire-extinguishing performance or low ignition propensity, of cigarettes C1, C2 and E1 to E15 in the above-described dangerous situation.

C1 and C2 are cigarettes of Comparative Examples, which are made of wrapping papers A and B. E1 to E15 are cigarettes of Embodiments, which are made of wrapping papers having highly conducting bands 10 obtained by calendering of various forms and wrapping papers having not only the highly conducting bands 10 but also burning depression bands 16. In TABLE 2, α represents the presence of the burning depression bands 16 made by a coating amount of 0.10 g/m$^2$, and P represents the presence of the burning depression bands 16 made by a coating amount of 0.24 g/m$^2$.

TABLE 2

| | Wrapping paper conditions | Shred filling amount (g/cig) | The number of cigarettes burnt to full lengths | The number of cigarettes extinguished before being burnt to full lengths | The number of tested cigarettes | Extinguishing rate (%) |
|---|---|---|---|---|---|---|
| C1 | A | 0.6400 | 20 | 0 | 20 | 0 |
| C2 | B | | 20 | 0 | 20 | 0 |
| E1 | A(S&S(15)) | | 12 | 8 | 20 | 40 |
| E2 | A(C&S(15)) | | 15 | 5 | 20 | 25 |
| E3 | A(A&S(15)) | | 17 | 3 | 20 | 15 |
| E4 | B(S&S(15)) | | 6 | 14 | 20 | 70 |
| E5 | B(C&S(15)) | | 12 | 8 | 20 | 40 |
| E6 | A(S&S(15)) + α | | 2 | 18 | 20 | 90 |
| E7 | A(C&S(15)) + α | | 9 | 11 | 20 | 55 |
| E8 | A(A&S(15)) + α | | 10 | 10 | 20 | 50 |
| E9 | B(S&S(15)) + α | | 7 | 13 | 20 | 65 |
| E10 | B(C&S(15)) + α | | 10 | 10 | 20 | 50 |
| E11 | A(S&S(15)) + β | | 4 | 16 | 20 | 80 |
| E12 | A(C&S(15)) + β | | 10 | 10 | 20 | 50 |
| E13 | A(A&S(15)) + β | | 9 | 11 | 20 | 55 |
| E14 | B(S&S(15)) + β | | 5 | 15 | 20 | 75 |
| E15 | B(C&S(15)) + β | | 14 | 6 | 20 | 30 |

The results of evaluation shown in TABLE 2 were obtained by a Cigarette Extinction Test Method. In this test method, a cigarette to be tested is first placed upright. In this position, the cigarette lets to be burnt up to 15 mm away from a top end thereof. Then, the lighted cigarette is left to lie in a horizontal position on a burnable material that is formed by superposing ten sheets of filter paper (item: Whatman No. 2). The extinguishing rates shown in TABLE 2 indicate the percentage of the number of cigarettes the smolders of which were extinguished before the cigarettes were burnt to their full lengths with respect to the number of the lighted cigarettes that were burnt to their full lengths.

The results of evaluation in TABLE 2 are shown in graphs of FIGS. 6 to 9 as well.

Figure 6:
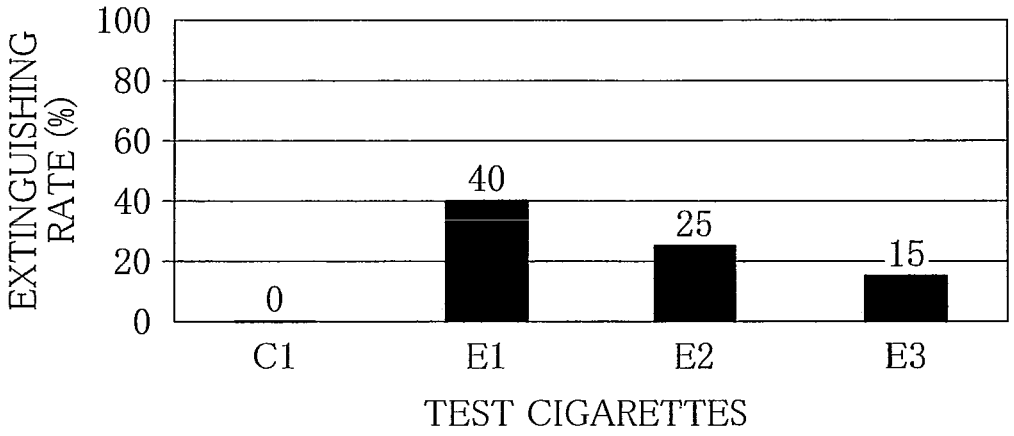
FIG. 6 is a graph showing extinguishing rates of test cigarettes.
Figure 7:
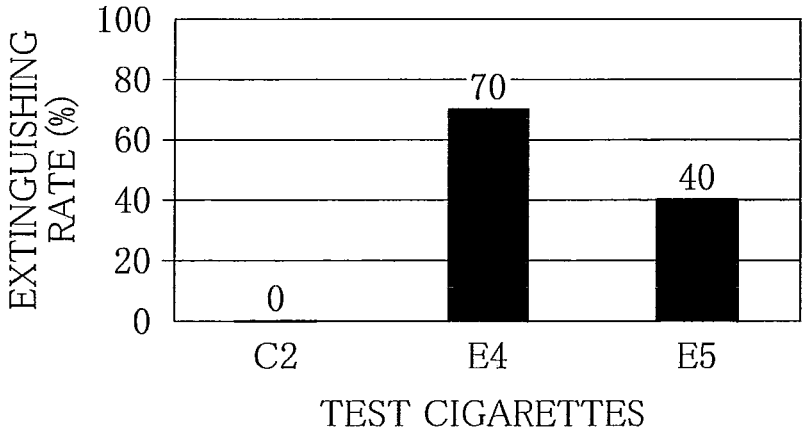
FIG. 7 is a graph showing extinguishing rates of test cigarettes.
Figure 8:
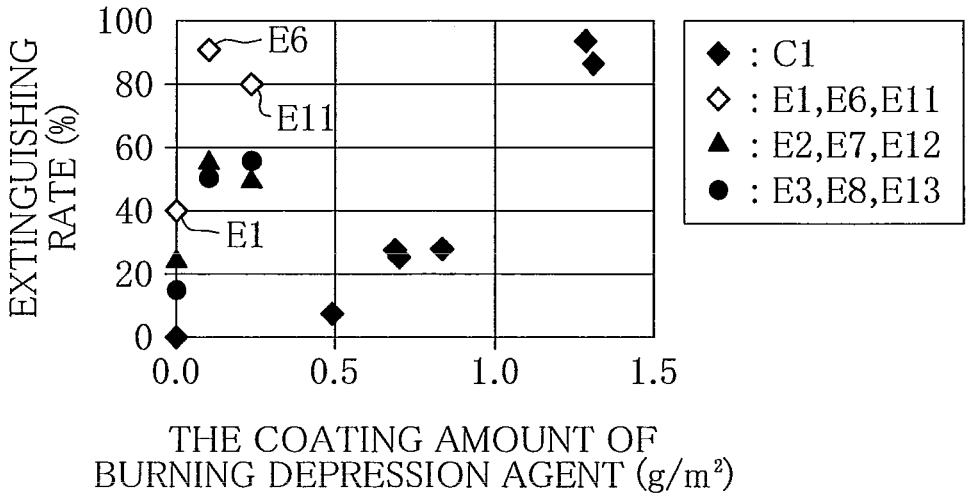
FIG. 8 is a graph showing relationship between a coating amount of a burning depression agent and the extinguishing rate.
Figure 9:
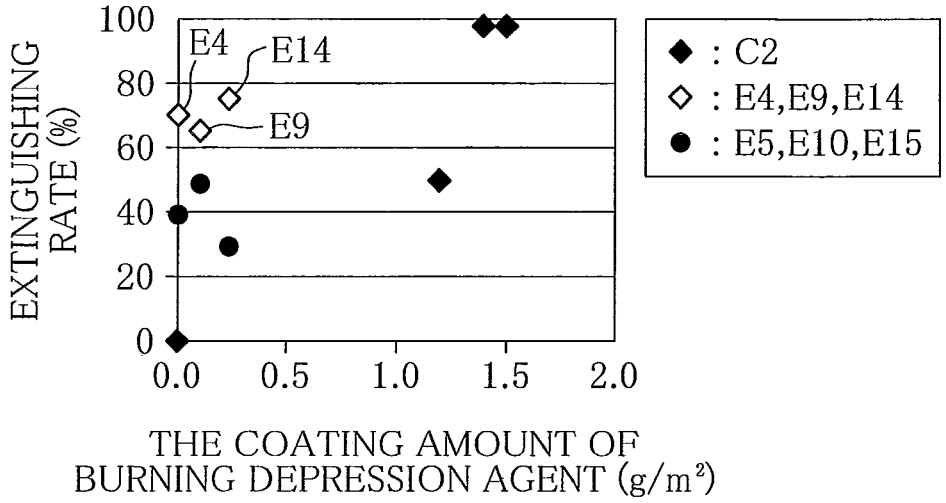
FIG. 9 is a graph showing relationship between a coating amount of the burning depression agent and the extinguishing rate.

FIG. 6 shows the extinguishing rates of Comparative Example C1 and Embodiments E1 to E3. FIG. 7 shows the extinguishing rates of Comparative Example C2 and Embodiments E4 and E5. FIGS. 8 and 9 show differences of Comparative Examples C1 and C2 and Embodiments E1 to E15, using the coating amount of the burning depression agent as a parameter.

As is apparent from FIGS. 6 and 7, the cigarettes of Embodiments E1 to E5, which include the highly conducting bands 10 in the wrapping papers 6, have higher extinguishing rates than the cigarettes of Comparative Examples C1 and C2, which do not include any highly conducting bands.

As is evident from FIGS. 8 and 9, the cigarettes of Embodiments E6 to E14, which include the highly conducting bands 10 and the burning depression bands 16, have higher extinguishing rates than the cigarettes of Embodiments E1 to E5.

FIGS. 8 and 9 show the cigarettes of Comparative Examples C1 and C2 and those of Embodiments E4, E6, E9 and E11, which achieve extinguishing rates of 60 percent or more. The burning depression bands of the cigarettes of Comparative Examples C1 and C2 have the burning depression agent of a coating amount of 1.3 g/m$^2$ or more. The burning depression bands of the cigarettes of Embodiments E4, E6, E9 and E11 have the burning depression agent of a coating amount of 0.1 to 0.24 g/m$^2$. This means that, in the case of Embodiments E4, E6, E9 and E11, the burning depression bands 16 contribute to the improvement of extinguishing rate in cooperation with the highly conducting bands 10, and then the coating amount of the burning depression agent, which is required for formation of the burning depression bands 16, is drastically reduced.

The highly conducting bands 10 are obtained by calendering, and the coating amount of the burning depression agent forming the burning depression bands 16 is very small as described above. Accordingly, the highly conducting bands 10 and the burning depression bands 16 do not greatly reduce air permeability of the wrapping papers 6 as a whole. Consequently, when the low ignition propensity cigarette of the invention is smoked, the smoker does not feel uneasiness and can smoke comfortably.

Figure 10:
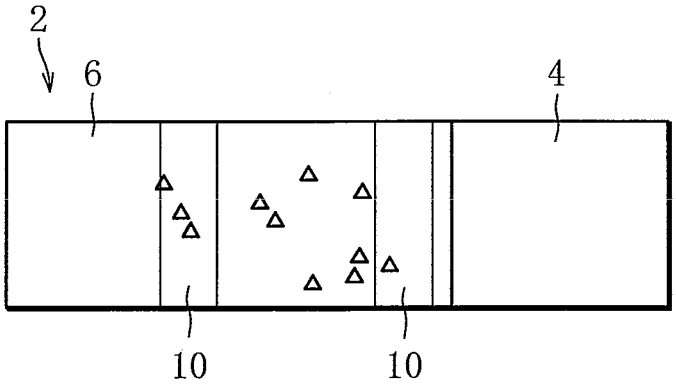
FIG. 10 is a view showing a result of an extinguishment test with respect to a cigarette including wrapping paper having only highly conducting zones.
Figure 11:
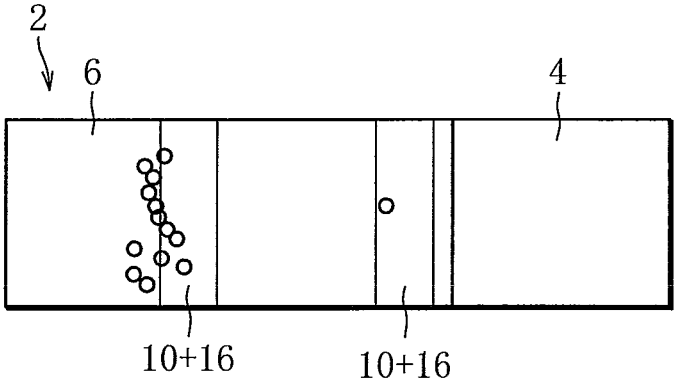
FIG. 11 is a view showing a result of an extinguishment test with respect to a cigarette including wrapping paper having highly conducting bands and burning depression bands.

FIGS. 10 and 11 show extinction positions with marks Δ and ○, respectively, which are obtained during the cigarette extinction test. The cigarette shown in FIG. 10 includes wrapping paper A having only the highly conducting bands 10, whereas the cigarette shown in FIG. 11 includes wrapping paper having the highly conducting bands 10 and the burning depression bands 16.

Figure 12:
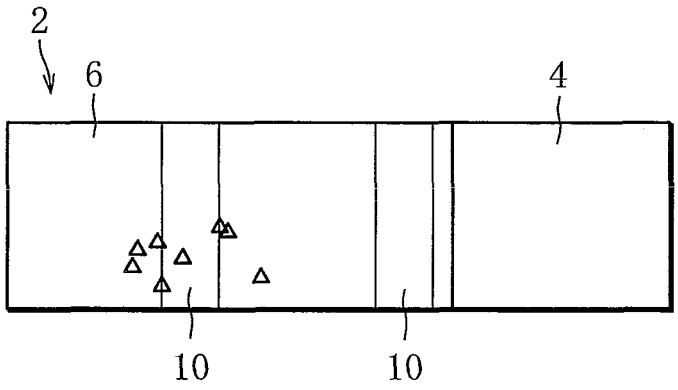
FIG. 12 is a view showing a result of an extinguishment test with respect to a cigarette identical to the cigarette shown in FIG. 10 except for air permeability of the wrapping paper.
Figure 13:
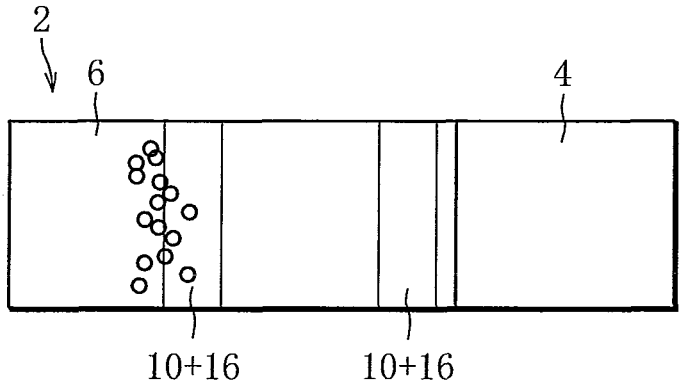
FIG. 13 is a view showing a result of an extinguishment test with respect to a cigarette identical to the cigarette shown in FIG. 11 except for air permeability of the wrapping paper.

FIGS. 12 and 13 show extinction positions with marks Δ and ○, respectively, which are obtained by the extinction test as in FIGS. 10 and 11. The cigarettes shown in FIGS. 12 and 13 differ from those shown in FIGS. 10 and 11 only in that they include wrapping paper B instead of wrapping paper A.

As is clear from FIGS. 10 to 13, in the case of cigarettes having both the highly conducting bands 10 and the burning depression bands 16, the extinction positions are concentrated on where the highly conducting bands 10 and the burning depression bands 16 are disposed. This means that the highly conducting bands 10 and the burning depression bands 16 effectively extinguish smolder in cooperation with each other.

Figure 14:
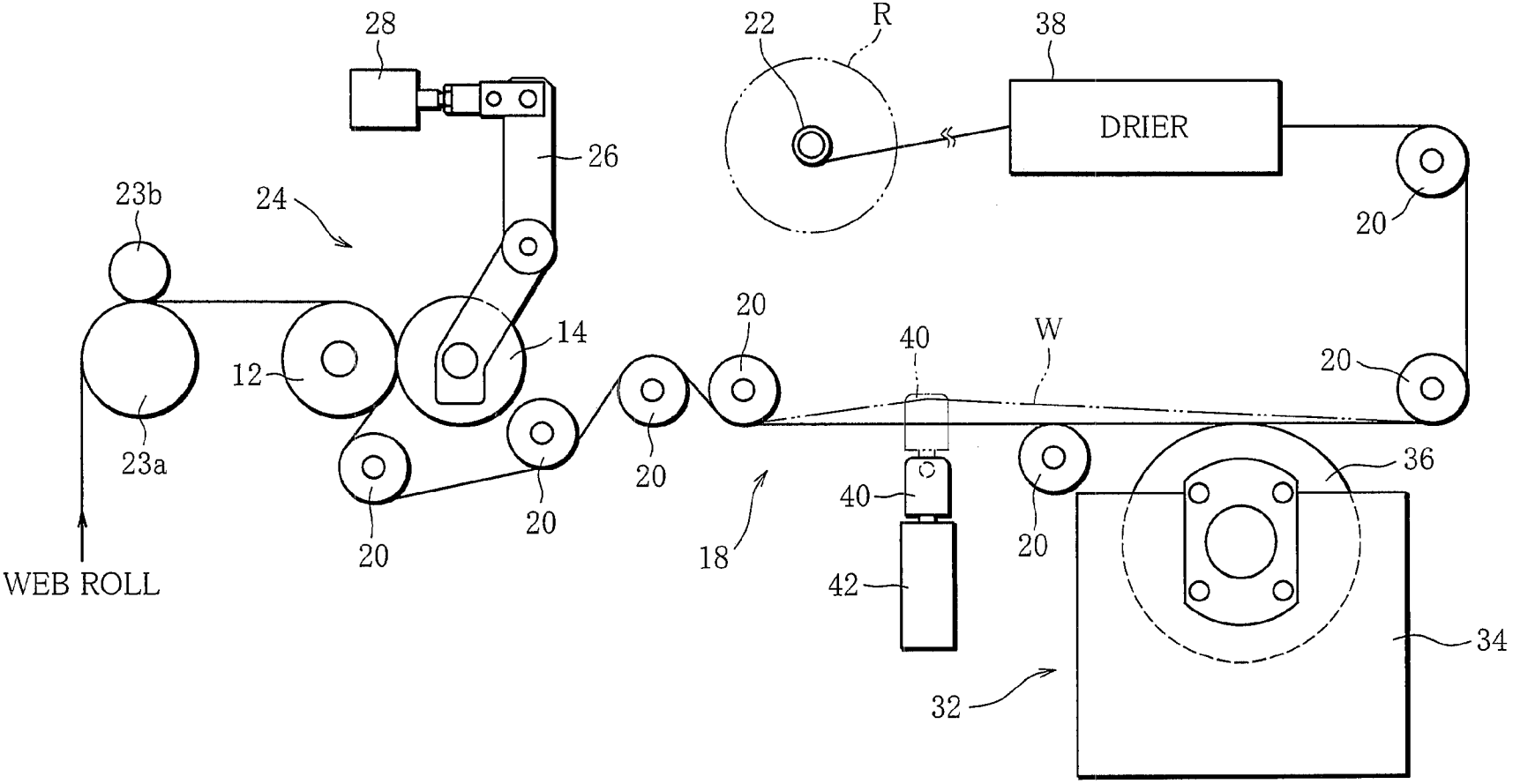
FIG. 14 is a schematic configuration view showing a calendering/coating apparatus.

FIG. 14 schematically shows a calendering/coating apparatus. This calendering/coating apparatus carries out a method of producing the wrapping paper 6 having the highly conducting bands 10 and the burning depression bands 16.

The calendering/coating apparatus has a running path 18 of web W for forming the wrapping paper 6. The running path 18 extends from a roll of the web W to a take-up reel 22, and includes a large number of guide rollers 20 for guiding the web W.

A pair of pinch rollers 23*a* and 23*b* is disposed in an upstream portion of the running path 18. A calendering machine 24 is arranged downstream of the pinch rollers 23. The calendering machine 24 has the calendering roller 12, which is rotatably supported. A press roller 14 is situated in the vicinity of the calendering roller 12. The press roller 14 is capable of moving toward and away from the calendering roller 12.

To be more specific, the press roller 14 is rotatably supported by a lower end of an arm 26. The arm 26 upwardly extends from the press roller 14 and rockably supported in the center thereof. A press cylinder 28 is connected to an upper end of the arm 26. The press cylinder 28 rocks the press roller 14 through the arm 26 by expanding and contracting motions thereof. As a result, the press roller 14 moves toward and away from the calendering roller 12.

Figure 15:
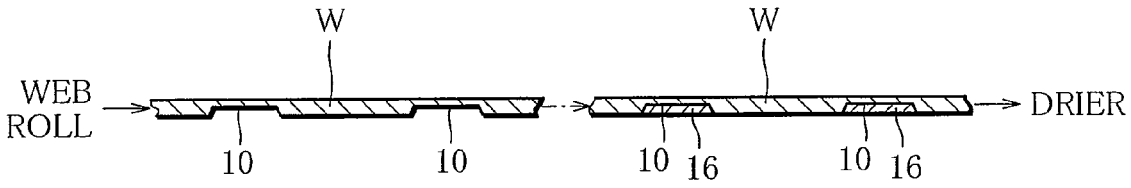
FIG. 15 is a view showing a web processed by the apparatus shown in FIG. 14.

While the calendering roller 12 is rotated, the web W passes through between the calendering roller 12 and the press roller 14. In this process, the web W is intermittently subjected to the calendering. Consequently, in the web W, the highly conducting bands 10 each having a band-like shape are formed at the above-mentioned intervals. As shown in FIG. 15, the highly conducting bands 10 are formed by partially concaving an inner surface of the web W. The highly conducting bands 10 therefore have less thickness than the web W.

A coating device 32 is located in the running path 18 in a downstream side of the calendering machine 24. The coating device 32 includes a solution tank 34. Contained in the solution tank 34 is a solution of sodium alginate, namely, burning depression agent. The coating device 32 further includes a transfer roller 36, which is rotatably carried on the solution tank in a state partially immersed in the solution within the solution tank 34.

As is obvious from FIG. 14, the web W passes the transfer roller 36 while contacting an outer circumferential surface of the transfer roller 36 in a downstream side of the calendering machine 24. In this process, the solution of the burning depression agent is transferred, or coated, from the outer circumferential surface of the transfer roller 36 onto the highly conducting bands 10 of the web W. Therefore, as shown in FIG. 15, the burning depression bands 16 are formed on the highly conducting bands 10. The burning depression bands 16 are superimposed upon the highly conducting bands 10. To be more concrete, the transfer roller 36 is provided on the outer circumferential surface thereof with a transfer pattern for transferring the solution to the web W at intervals corresponding to the intervals of the highly conducting bands 10. and is rotated at circumferential velocity synchronized with the rotation of the calendering roller 12.

The burning depression agent is coated onto the highly conducting bands 10 obtained by calendering, and therefore fits well onto the highly conducting bands 10. Accordingly, the burning depression bands 16 having desired coating amount can be formed only by once coating the highly conducting bands 10 with the burning depression agent.

A drier 38 is arranged in the running path 18 in a downstream side of the coating device 32. The web W on which the burning depression bands 16 are formed passes the drier 38 in the downstream side of the coating device 32. In this process, the burning depression bands 16 of the web W are subjected to a drying process. The web W that has passed the drier 38 is reeled in the take-up reel 22. A roll R of the wrapping paper 6 having the highly conducting bands 10 and the burning depression bands 16 is formed in the take-up reel 22.

In the running path 18, a retrieve guide 40 is interposed between the calendering machine 24 and the coating device 32. The retrieve guide 40 is attached to a rod end of a retrieve cylinder 42.

When the calendering/coating apparatus is at rest, the retrieve cylinder 42 extends from a state illustrated, to thereby upwardly move the retrieve guide 40. The upward movement of the retrieve guide 40 lifts a portion of the web W as shown by a chain double-dashed line, and then detaches the web W from the transfer roller 36 of the coating device 32.

The roll R is supplied to a cigarette making machine, not shown, and is used for production of cigarettes.

In the calendering/coating apparatus, the calendering machine 24 may be disposed downstream of the coating device 32. However, considering the coating properties of the burning depression agent, the coating device 32 is preferably located downstream of the calendering machine 24. The calendering/coating apparatus itself is incorporable into a cigarette making machine.

The invention is not limited to the low ignition propensity cigarette, the wrapping paper, and the method of producing wrapping paper according to the one embodiment. Instead, the invention may be modified in various ways.

Figure 16:
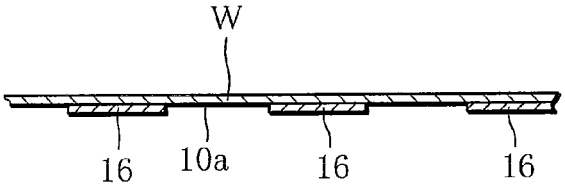
FIG. 16 is a view showing a web subjected to the calendering and the coating processing into an another form than the web shown in FIG. 15.
Figure 17:
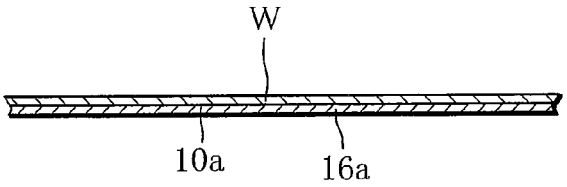
FIG. 17 is a view showing a web processed into a still another form.

For instance, the highly conducting bands 10 are not limited to an example shown in FIG. 1 in terms of numbers, width, intervals or the like with respect to each cigarette. The burning depression bands 16 do not need to be completely superposed upon the highly conducting bands 10. That is, the burning depression bands 16 partially overlap with the highly conducting bands 10 in an axial direction of the cigarette 2, but may have portions superposed upon the entire highly conducting bands 10 in a circumferential direction of the cigarette 2. Furthermore, as illustrated in FIG. 16, the web W, namely, the wrapping paper 6, may have a highly conducting region 10*a* the entire region of which is subjected to calendering. In this case, the burning depression bands 16 may be formed at predetermined intervals in a longitudinal direction of the web W (cigarette) (FIG. 16). Alternatively, there may be provided with an burning depression layer 16*a*, instead of the burning depression band 16, which is formed in the entire region of a back surface of the web W (interior surface of the wrapping paper 6) (FIG. 17).

The burning depression bands 16 and layer 16*a* can be made of a burning depression agent other than sodium alginate.

The invention claimed is:

1. A low ignition propensity cigarette comprising: filling material; and a single wrapping paper wrapping said filling material into a rod-like shape, said wrapping paper providing a low ignition propensity for the cigarette, wherein said wrapping paper comprises:

a highly conducting zone comprising a recess formed by calendering said wrapping paper, said highly conductive zone having a higher thermal conductivity than an inherent thermal conductivity of said wrapper, but having a lower thermal conductivity than needed to reliably extinguish a smolder of a cigarette which is in a state of smoldering; and a burning depression layer formed by coating a burning depression agent on and into said recess of said highly conductive zone, wherein a combined thermal conductivity of the highly conductive zone with the burning depression layer formed there on is above about 0.45 W/(K·m) which is the minimum thermal conductivity sufficient to reliably extinguish a smolder of the cigarette with is in a state of smoldering in said highly conducting zone.

2. The low ignition propensity cigarette according to claim 1, wherein the thermal conductivity of said highly conducting zone is higher than the inherent thermal conductivity by 7.4 to 27.7%.

3. The low ignition propensity cigarette according to claim 1, wherein a coating amount of the burning depression layer is 0.1 to 0.24 g/m$^2$.

4. A wrapping paper for a low ignition propensity cigarette, said wrapping paper comprising paper material, wherein said wrapping paper comprises:

a highly conducting zone comprising a recess formed by calendering said wrapping paper, said highly conductive zone having a higher thermal conductivity than an inherent thermal conductivity of said wrapper, but having a lower thermal conductivity than needed to reliably extinguish a smolder of a cigarette which is in a state of smoldering; and a burning depression layer formed by coating a burning depression agent on and into said recess of said highly conductive zone, wherein a combined thermal conductivity of the highly conductive zone with the burning depression layer formed there on is above about 0.45 W/(K·m) which is the minimum thermal conductivity sufficient to reliably extinguish a smolder of the cigarette with is in a state of smoldering in said highly conducting zone.

5. The wrapping paper according to claim 4, wherein the thermal conductivity of said highly conducting zone is higher than the inherent thermal conductivity by 7.4 to 27.7%.

6. The wrapping paper according to claim 4, wherein a coating amount of the burning depression layer is 0.1 to 0.24 g/m$^2$.

* * * * *